United States Patent [19]

Sloan

[11] Patent Number: 4,502,090

[45] Date of Patent: Feb. 26, 1985

[54] PROTECTIVE CONTROL SYSTEM FOR ENGINE

[76] Inventor: Albert H. Sloan, 4200 Kean Rd., Fort Lauderdale, Fla. 33314

[21] Appl. No.: 469,292

[22] Filed: Feb. 24, 1983

[51] Int. Cl.[3] ..... H01H 47/22

[52] U.S. Cl. ..... 361/153; 361/154; 361/190; 361/25

[58] Field of Search ..... 361/152, 153, 154, 189, 361/190, 25; 123/478, 479, 490, 499

[56] References Cited

U.S. PATENT DOCUMENTS 3,904,938 9/1975 Martin ..... 361/154

*Primary Examiner*—Reinhard J. Eisenzopf
*Attorney, Agent, or Firm*—James E. Nilles

[57] ABSTRACT

A protective control system is provided for stopping an engine-driven pump when a fault condition such as low oil level, low oil pressure or high temperature occurs in the engine. The protective control system includes an electric battery, a solenoid valve regulating fuel (or air) flow to the engine and energizable from the battery, an electronic circuit energizable from the battery for controlling the solenoid valve, and fault-sensing switches for controlling the electronic circuit and shutting off the fuel supply to stop the engine upon occurrence of a fault. The electronic circuit includes a solid state voltage regulator device connected between the battery and the solenoid valve, and this device includes an adjustment terminal which is biased to control the power supply to the solenoid valve. The electronic circuit further includes a transistor which controls the bias on the adjustment terminal and the transistor, in turn, is responsive to operation of any one of the fault-responsive switches. An LED in the control system indicates the energization status of the solenoid valve.

8 Claims, 5 Drawing Figures

PROTECTIVE CONTROL SYSTEM FOR ENGINE

BACKGROUND OF THE INVENTION

1. Field of Use

This invention relates generally to protective control systems for preventing or stopping operation of equipment driven by internal combustion engines in the event of the existence or occurrence of fault conditions, such as low oil level, low oil pressure, high engine temperatures or the like.

In particular, it relates to such protective control systems which embody electric circuits including electric devices responsive to fault-sensing switches to control electrically operated actuators such as solenoid valves or the like.

2. Description of the Prior Art

Certain types of equipment, such as large water pumps which are driven by internal combustion engines to remove unwanted water from excavations and so forth, are intended to operate for relatively long periods of time while the human operator is not present and in many instances are under the supervision of persons who are not necessarily expert in the care, operation or maintenance of such engines. Accordingly, it is the practice to provide protective control systems for preventing start-up or running of the equipment if, for example, the oil level in the engine is too low or the engine is overheated from some unusual previous condition, and the human operator is unaware of these conditions. Such prior art protective systems also cause automatic shut-down of the equipment if low oil level, low oil pressure, high engine temperature or other undesirable fault conditions arise while the engine is running but unattended. Some prior art protective control systems embody electric circuits including electro-mechanical relays responsive to fault-sensing switches to operate switches which, in turn, actuate electrically operated actuators to shut off the engine. In some engines, these actuators take the form of solenoid valves which shut-off fuel flow to the engine. In other engines where fuel cut-off is a prohibited practice, these actuators take the form of a momentarily energizable solenoid operable to pull a latch which unlatches a flapper valve in the engine air intake and cuts off incoming air to the engine. Usually, provision is made to by-pass the protective control system to allow for start-up for limited engine operation. The heretofore-mentioned electro-mechanical relays and associated relay switches, since they embody movable components, are difficult to seal against entry of dirt, water and other contaminants, are prone to wear out because of repeated use and are also subject to vibrations which can cause accidental relay operations which shut down the equipment unnecessarily. In some cases, human operators even tamper with the relay (as, for example, inserting toothpicks to prevent motion of mechanical parts) to prevent unwarranted shutdowns, but these practices defeat the entire purpose of the protective control system. Some prior electro-mechanical relays also employ replaceable fuses which are inconvenient, time-consuming and costly to replace on the job site.

SUMMARY OF THE PRESENT INVENTION

In accordance with the present invention there is provided an improved protective control system for preventing operation or stopping operation of apparatus in the event of a fault condition. The system is especially well-adapted for use with internal combustion engines which drive large pumps or the like and operates to shut off fuel flow or air flow to the engine in the event of existence or occurrence of a fault condition such as low oil level, low oil pressure, high engine temperature or the like. However, the use or responsiveness of a protective control system in accordance with the invention is not so limited.

A protective control system in accordance with the invention for preventing operation of such apparatus in the event of occurrence of a fault condition comprises a component, such as a fuel valve, on the apparatus movable between one position which enables operation of the apparatus and another position which prevents operation of the apparatus. The system further comprises a source of electric power and an actuator energizable from the source of power and operable to move the component. The system also comprises an electronic circuit including a solid state voltage regulating device connected between the source of electric power and the actuator, and said device comprises an adjustment terminal responsive to the magnitude of a bias signal thereon to regulate the power supplied to the actuator from the source of electric power and thereby effect movement of said component on the apparatus. The electronic circuit further includes an impedance, such as a resistor, connected between the adjustment terminal and the source of electric power, and switch means responsive to a fault condition to control shunting of the impedance to effect the magnitude of the bias signal. In a preferred embodiment the switch means comprises a transistor having its emitter-collector circuit connected across the impedance, and further comprises at least one fault responsive switch connected to the base terminal of the transistor. A light-emitting diode is connected between the output terminal of the voltage regulating device to indicate when the output terminal (and actuator) is energized.

In operation, assuming that the fault-sensing switch is open and that, therefore, the transistor is biased to off, electric power from the source then flows through the voltage regulating device to the actuator to energize the latter at a set voltage and allows the engine component (i.e., the fuel valve) to enable the engine to be started or to continue running. The light-emitting diode turns on to visually indicate such enabled condition. However, if the fault-sensing switch closes in response to a fault, the bias normally applied to the transistor base terminal is diverted to ground through the closed fault-sensing switch. As a result, the transistor turns "on" thereby causing the impedance to be shunted and causing the bias applied to the adjustment terminal of the voltage device to be charged. This, in turn, causes the output voltage of the voltage regulating device to drop to a value which is too low to maintain the actuator energized. As a result, the engine component operates to prevent engine start-up or to prevent continued engine operation, i.e., the fuel valve closes to cut off fuel, and the light-emitting diode turns off to visually indicate the de-energized condition.

A protective control system in accordance with the invention offers several advantages over the prior art. For example, since it employs solid state electronic devices instead of electro-mechanical components, it is trouble-free and reliable in use, has a long service life, and is easily potted in a compact protective, waterproof, insulated housing. The system is also less costly to fabricate, install and service. Other objects and advantages of the invention will hereinafter appear.

DRAWINGS

DESCRIPTION OF PREFERRED EMBODIMENTS

Figure 1:
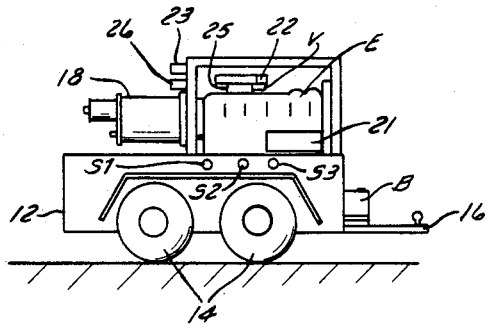
FIG. 1 is a side elevational view of a piece of equipment, such as a trailer-mounted internal combustion engine-driven pump, on which a protective control system in accordance with the invention is mounted.

Referring to FIG. 1, the numeral 10 designates a piece of equipment with which a protective control system in accordance with the invention is employed. The piece of equipment 10 comprises a trailer chassis 12 having wheels 14 and a tongue 16 whereby it is connectable to a truck (not shown) for road transport to a jobsite. The piece of equipment 10 further comprises a pump 18 and an internal combustion engine E, such as a diesel engine, for driving the pump, both of which are mounted on chassis 12. A source of electrical power, such as a battery B, is mounted on chassis 12 for energizing a starter motor 21 for starting engine E. A control panel 23 is provided on chassis 12 and houses switches and other components for operating and monitoring engine E and pump 18. Control panel 23 houses certain parts of the protective control system, as hereinafter described.

The protective control system, which includes battery B as its power supply, also includes an electrically operable actuator such as a solenoid 22 associated with a valve V on an engine fuel injection pump 25, an electronic circuit 24 which is part of a potted circuit assembly 26 mounted in control panel 23, and fault-responsive switch means including, for example, three fault-sensing switches S1, S2 and S3 mounted on engine E at locations as shown in FIG. 1.

Figure 2:
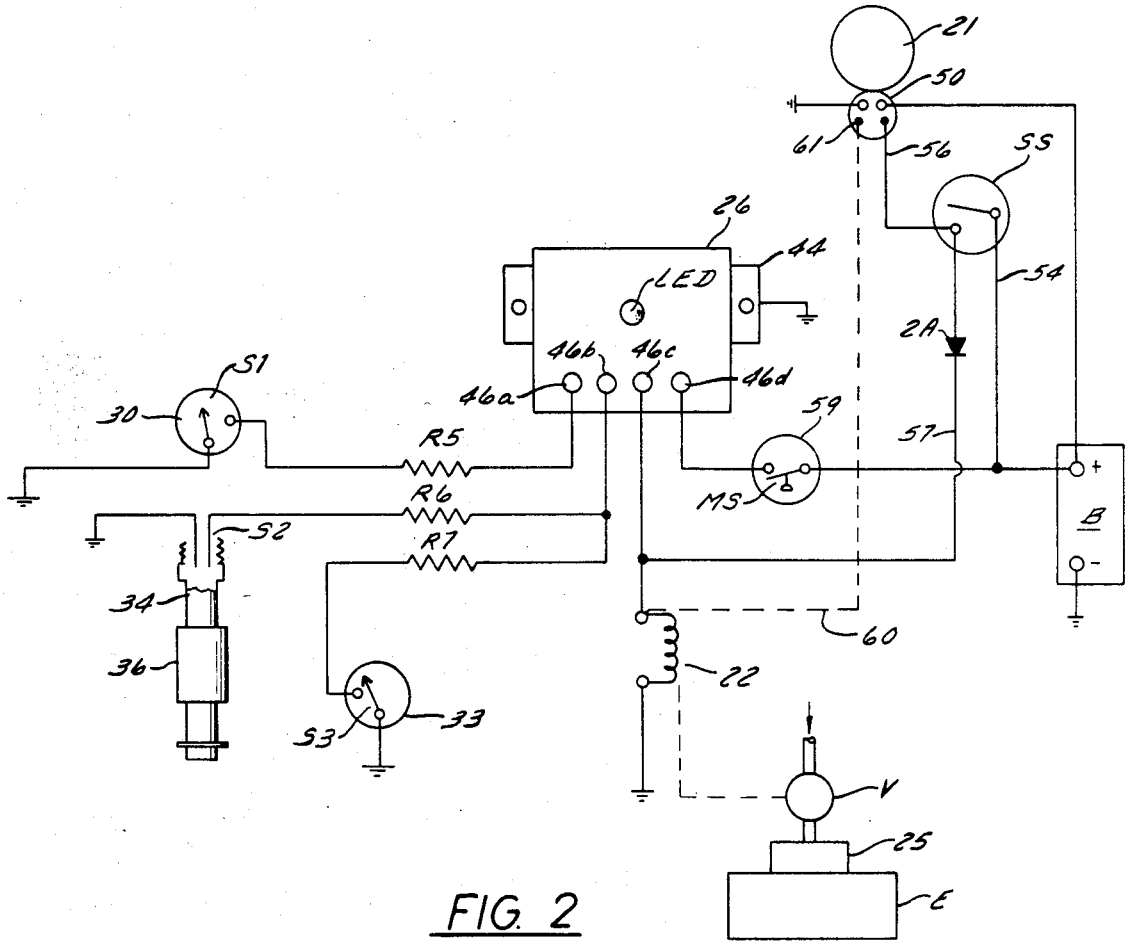
FIG. 2 is a schematic diagram of portions of the protective control system of FIG. 1, including a potted electronic circuit assembly thereof.
Figure 5:
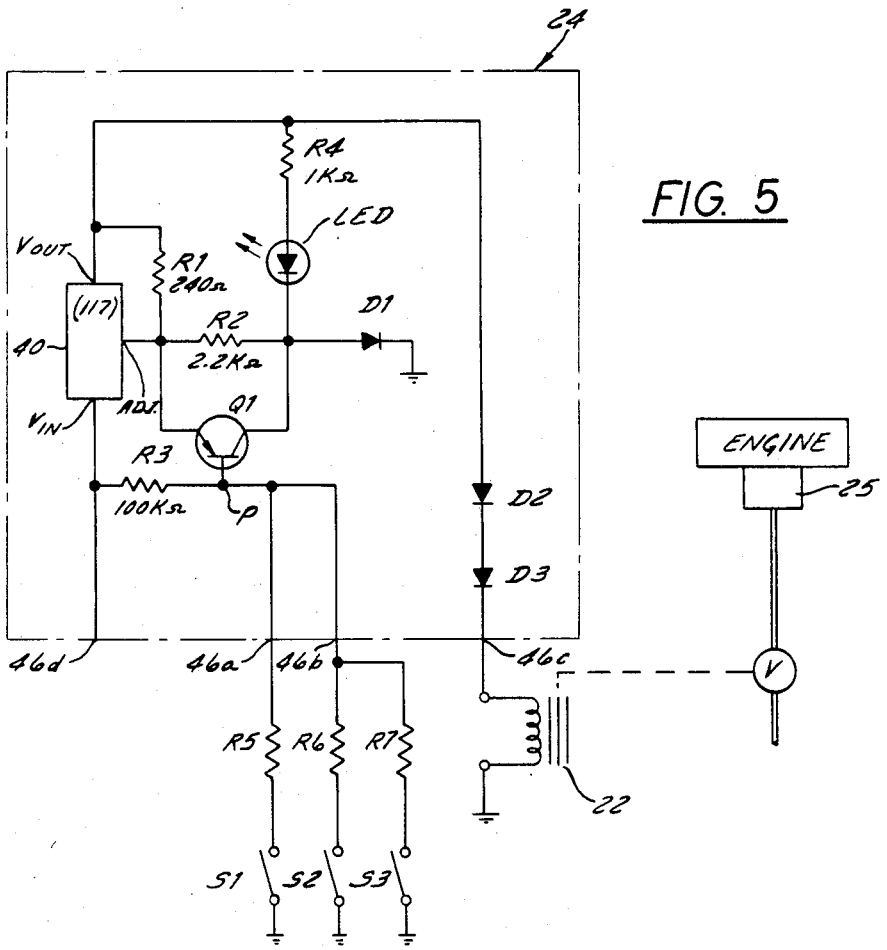
FIG. 5 is an electric circuit diagram of the protective control system including components shown in FIG. 2 and FIG. 4.

Referring to FIGS. 1, 2 and 5, it is to be understood that valve V is actuated by solenoid 22 and controls the flow of fuel, such as diesel fuel, to engine injector pump 23. If preferred, valve V could take the form of a valve which controls the flow of air to the engine 23. When solenoid 22 is energized, valve V is open and engine E is able to run, i.e. able to start or able to continue running.

As FIG. 2 shows, starter motor 21 is associated with a starter solenoid 50 and a selectively operable normally open pushbutton type starter switch SS. One side of starter switch SS is connected by a conductor wire 54 to the positive terminal of battery B and the other side of starter switch SS is connected, first, by a conductor wire 56 to one side of starter solenoid 50 and, second, by a conductor wire 57 and through a diode 2A to the ungrounded side of valve solenoid 22. The other side of the starter solenoid 50 is connected to ground. The positive terminal of battery B is connectable through a normally open switch MS embodied in an oil pressure responsive unit 59 which closes during engine cranking when engine oil pressure builds up to 5 pounds per square inch of pressure, for example, to effect energization of electronic control circuit 24.

If preferred, instead of using starter switch SS, the conductor 57 and diode 2A to supply power to initially energize solenoid 22 during starting, an alternative conductor 60 (shown as a broken line) connected to an energizable auxiliary terminal 61 on starter relay 50 could be used to energize solenoid 22. Such alternate arrangement would typically be employed in conventional key-operated starter systems.

Referring to FIGS. 1, 2 and 5, it is to be understood that fault-sensing switch S1 is embodied in a commercially available engine temperature sensing unit 30. Switch S1 is a single pole, normally open electric switch which closes to complete a circuit therethrough when engine temperature increases to a predetermined level (i.e., 220° F., for example) and remains closed as long as the temperature is at or above that level. Sensing unit 30 is shown as embodying a gauge including a needle which gives a visual read-out of temperature and the needle takes the form of the movable leaf in switch S1.

Fault-sensing switch S2 is embodied in a commercially available level sensing unit 32. Switch S2 is a single pole, normally open electric switch which closes to complete a circuit therethrough when engine oil level decreases to a predetermined level and remains closed as long as the oil is at or below that level. Sensing unit 32 is shown as embodying a tube 34 in which the contacts S2 are located and which remain open as long as an axially slidable bouyant magnetized sleeve 36 is disposed therearound and which close when the sleeve descends in response to low oil level.

Fault-sensing switch S3 is embodied in a commercially available engine oil pressure sensing unit 33. Switch S3 is a single pole, normally open electric switch which closes to complete a circuit therethrough when engine oil pressure decreases to a predetermined level below a normal system pressure of about 45 pounds per square inch, for example, and remains closed as long as the oil pressure is at or below that level. Sensing unit 33 is shown as embodying a gauge including a needle which gives a visual read-out of oil pressure and the needle takes the form of a movable leaf in switch S3.

As FIGS. 2 and 5 show, the protective control system in accordance with the invention generally comprises the source of electric power, such as electric battery B; the electrically operable actuator device 22 energizable from the power source B, such as solenoid 22 for actuating the component V associated with the equipment 10 which effectively controls equipment operation, such as fuel valve V (or an air supply valve) for injection pump 25; the electronic circuit 24 energizable from the electric power source B for controlling the power supply from the electric power source B to the actuator device 22; and the fault-sensing or fault-responsive switch means, including the plurality of normally open fault-sensing switches S1, S2, S3 and MS, for effecting operation of the electronic circuit. Resistors R5, R6 and R7 are in circuit with the switches S1, S2 and S3, respectively, and prevent an uninformed mechanic who attempts to jump the load or battery to a sensor terminal from destroying the sensor. As hereinafter explained, switch MS is normally open but is actuated to closed position when a starter switch SS for starter motor 21 is depressed and oil pressure builds to a proper level.

The electronic circuit 24 comprises solid state devices including a solid state adjustable three-terminal positive voltage "floating" regulator device 40 (Texas Instruments type LM117 series device, for example), a normally "on" PNP transistor Q1 (type 3906), a light-emitting diode LED, seven resistors designated R1, R2, R3, R4, R5, R6 and R7, and three diodes designated D1, D2 and D3.

Figure 3:
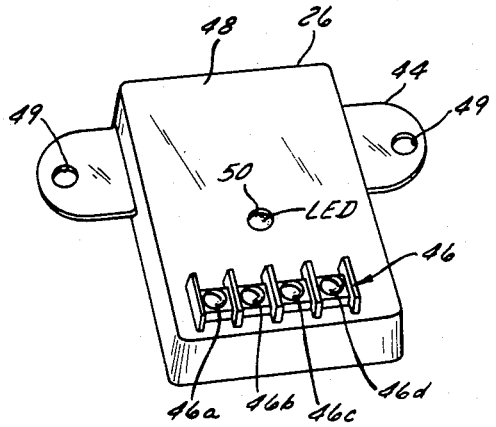
FIG. 3 is an enlarged perspective view of the potted electronic circuit assembly of FIG. 2.
Figure 4:
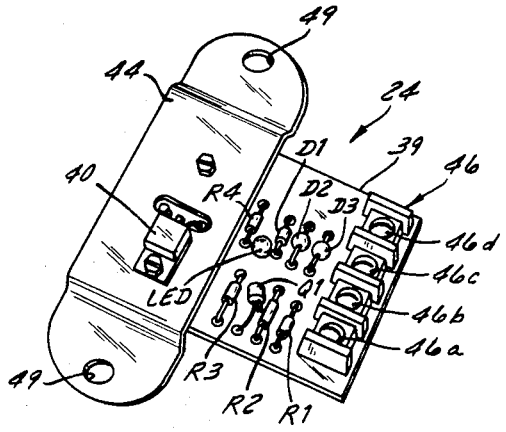
FIG. 4 is a perspective view of the electronic circuit assembly of FIG. 3 with the exterior potting material deleted to show interior details.

As FIGS. 3 and 4 show, the electronic circuit 24 is embodied in an electronic circuit assembly 26 which is physically mounted on control panel 23 (see FIG. 1). Assembly 26 comprises a printed circuit board 39 on which are mounted the regulator device 40, transistor Q1, resistors R1 through R4, diodes D1 through D3, light-emitting diode LED, a combined metal head sink and mounting strap 44 to which regulator device 40 is attached, and a terminal board 46 having four terminal screws 46*a*, 46*b*, 46*c*, 46*d*. As FIG. 3 shows, these board-mounted components are embedded or cast in an electrically insulating moisture impervious hardened potting compound housing 48 and arranged so that the ends of the combined mounting strap and heat sink 44 protrude so as to provide attachment means, including the two screw holes 49 therein. The light-emitting diode LED is visible through a molded hole 50 and the major portion of terminal board 46 projects from molded housing 48 so that the screw terminals 46*a* through 46*d* are externally accessible.

The voltage regulator device 40 includes an input terminal $V_{in}$ connected to the positive battery terminal (the negative battery terminal being grounded); an output terminal $V_{out}$ connected to one side of the actuator device 22 (the other side being grounded) through the two diodes D2, D3 (to prevent reverse current flow); and an adjustment terminal ADJ connected to ground through an adjusting resistor R2 and the remaining diode D1, which diode protects against reverse polarity. The voltage regulator device 40 sees only the input-to-output differential voltage between its input and output terminals (which voltage is adjustable, for example, from 1.2 volts to 37 volts output range) and requires only the two resistors R1 and R2 (of selected values) to set or select the output voltage (i.e., one resistor R1 between the adjustment terminal ADJ and the output terminal $V_{out}$ and the other resistor R2 being the aforementioned adjusting resistor). The transistor Q1 has its normally closed emitter-collector terminals connected across the adjusting resistor R2 and has its base terminal connected to a point P between resistor R3 in series with the positive battery terminal 46*d* and the terminals 46*a*, 46*b* on one side of each of the three of normally open fault-sensing switches S1, S2 and S3 (the other side of each such switch being connected to ground). The light-emitting diode LED is connected in series with resistor R4 between the output terminal $V_{out}$ of the voltage regulator device 40 and ground (in series with diode D1) to indicate when the output terminal $V_{out}$ is energized.

In operation of the pushbutton starter system shown in FIG. 2 (as distinguished from a key-operated system), when the starter switch SS is manually closed, two things occur: first, the starter solenoid 50 is energized to operate the starter motor 21 and crank the engine E; and second, the solenoid 22 is connected to the battery B through conductor 54, switch 55, diode 2A and conductor 57. The fuel solenoid 22 is energized as long as the starter switch SS is held closed. This gives an initial shot of fuel into the injector 25 and allows the engine E to start as it is being cranked. Once the operator removes his finger and opens the starter switch SS, starter motor 21 becomes deenergized. However, if the oil pressure hasn't built up sufficiently (to 5 psi, for example) to close switch MS and to thus maintain operating conditions, the engine E will stop because the solenoid 22 becomes deenergized. However, assume that oil pressure builds to 5 psi and then on to 45 psi and above and switch MS closes and that all fault-sensing switches S1, S2, S3 are open. In this situation, therefore, the transistor Q1 is biased to off or open from the battery B, electric power from the battery B then flows from the input terminal $V_{in}$ to the output terminal $V_{out}$ of the voltage regulator device 40 and from thence to the actuator 22 to energize the latter at the set voltage and allow the engine component (i.e., fuel valve V or an air valve) to enable operation of the engine E. The light-emitting diode LED turns on to visually indicate such enabled condition. However, if any one (or several) of the fault-sensing switches S1, S2, S3 closes in response to a fault, the bias normally applied to the transistor base terminal at point P is diverted or shorted to ground through whichever of the fault-sensing switches is closed. As a result, the transistor Q1 turns "on" thereby causing the adjust resistor R2 to be by-passed and causing the adjustment terminal ADJ of the voltage device to be connected to ground through the transistor Q1 and diode D1. This, in turn, causes the voltage at the output terminal $V_{out}$ of the voltage regulator device 40 to drop to its lowest value (i.e., 1.2 volts, for example) which is too low to maintain the actuator 22 energized. However, to prevent the actuator 22 from "holding" in view of the small residual voltage available, the two diodes D2 and D3 in circuit therewith provide, for example, a voltage drop of 1.4 volts (if rated at 0.7 volts each) to provide 0 (zero) voltage to the actuator 22 and assure its dropout. Similarly, if switch MS opens due to very low oil pressure (i.e., below 5 psi), the circuit 24 becomes deenergized and the engine E cannot start. As a result, the engine component or valve V operates to prevent engine start-up or to prevent continued engine operation (i.e., the fuel valve V closes to cut off fuel or the air valve closes to cut off air). The light-emitting diode LED turns off to visually indicate the condition.

I claim:

1. A control system for controlling energization of a load from a source of electric power in response to a predetermined condition comprising:

a source of electric power;

a load energizable from said source of electric power;

a circuit including a solid state voltage regulating device connected between said source of electric power and said load, said device comprising an adjustment terminal responsive to the magnitude of a bias signal thereon to regulate the power supplied to said load from said source of electric power;

said circuit further including an impedance connected between said adjustment terminal and said source of electric power;

and switch means responsive to said predetermine condition to control shunting of said impedance to effect the magnitude of said bias signal, said switch means comprising a transistor having its emmitter-collector circuit connected across said impedance, and further comprising at least one condition responsive switch connected to said base terminal of said transistor.

2. A control system according to claim 1 wherein said impedance comprises a resistor.

3. A protective control system for preventing operation of apparatus in the event of occurrence a fault condition effecting operation of said apparatus, said protective control system comprising:

a component on said apparatus movable between one position which enables apparatus operation and another position which prevents operation of said apparatus;

a source of electric power;

an actuator energizable from said source of power and operable to move said component;

an electronic circuit including a solid state voltage regulating device connected between said source of electric power and said actuator, said device comprising an adjustment terminal responsive to the magnitude of a bias signal thereon to regulate the power supplied to said actuator from said source of electric power and thereby effect movement of said component on said apparatus;

said electronic circuit further including an impedance connected between said adjustment terminal and said source of electric power;

switch means to control shunting of said impedance to effect the magnitude of said bias signal;

and means for sensing occurrence of said fault condition and for effecting operation of said switch means in response thereto.

4. A protective system according to claim 3 wherein said switch means comprises a transistor having its emitter-collector circuit connected across said impedance, and further comprises at least one condition responsive switch connected to said base terminal of said transistor.

5. A protective control system according to claim 4 wherein said impedance comprises a resistor.

6. A protective contol system according to claim 3 or 4 including a light-emitting device energizable from the said voltage regulating device.

7. A protective control system for preventing operation of apparatus, such as an engine for a pump, in the event of occurrence of a fault condition effecting operation of said apparatus, such as low oil pressure or low oil level or the like, said protective control system comprising:

valve means on said engine movable between one position which enables engine operation and another position which prevents operation of said engine;

a source of electric power;

an actuator energizable from said source of power and operable to move said valve means;

an electronic circuit including a solid state voltage regulating device connected between said source of electric power and said actuator, said device comprising an adjustment terminal responsive to the magnitude of bias signal thereon to regulate the power supplied to said actuator from said source of electric power and thereby effect movement of said valve means on said engine;

said electronic circuit further including a resistor connected between said adjustment terminal and said source of electric power;

switch means to control shunting of said resistor to effect the magnitude of said bias signal and thereby prevent operation of said engine in the event of said fault;

and means for sensing occurrence of said fault condition and for effecting operation of said switch means in response thereto.

8. A protective system according to claim 7 wherein said switch means comprises a transistor having its emitter-collector circuit connected across said resistor, and further comprises at least one switch responsive to said fault condition and connected to said base terminal of said transistor.

* * * * *